United States Patent [19]

Lindler et al.

[11] 4,368,749

[45] Jan. 18, 1983

[54] WIRELESS UMBRELLA FRAME

[75] Inventors: James M. Lindler; Joe B. Bailey, Jr., both of Lexington, S.C.

[73] Assignee: The Shakespeare Company, Columbia, S.C.

[21] Appl. No.: 972,522

[22] Filed: Dec. 22, 1978

[51] Int. Cl.[3] ..... A45B 25/02

[52] U.S. Cl. ..... 135/20 R; 135/28

[58] Field of Search ..... 135/20 R, 25, 26, 28

[56] References Cited

U.S. PATENT DOCUMENTS

| | | | |
|---|---|---|---|
| 2,101,510 | 12/1937 | Rathbun | 135/28 |
| 2,321,495 | 6/1943 | Levin | 135/28 |
| 3,424,180 | 1/1969 | Andolfi | 135/28 X |

*Primary Examiner*—J. Karl Bell

*Attorney, Agent, or Firm*—Hamilton, Renner & Kenner

[57] ABSTRACT

An umbrella frame having an upper mounting member (11) fixed on the upper end of a central shaft (10) and a lower mounting member (12) slidable on said shaft with a circumferential series of outer ribs (13) pivoted at the upper end to the upper mounting member (11), and stretcher rods (16) pivotally connecting intermediate portions of said ribs (13) to said lower mounting member (12). The pivotal connections between the mounting members (11) and (12) and the ribs (13) and rods (16) are locked in place by retainer plates (25) and (25*a*) respectively, movable on the shaft (10).

3 Claims, 6 Drawing Figures

WIRELESS UMBRELLA FRAME

TECHNICAL FIELD

The invention relates to folding umbrellas having a protective membrane supported on a skeleton framework adapted to selectively expand the membrane into convex shape and collapse it to folded condition.

BACKGROUND ART

Most conventional folding umbrella frames have metal rib and stretcher mounting members on a central rod or shaft, the lower mounting member or runner being slidable on the shaft to expand the ribs and stretch the membrane and to fold the ribs and membrane inward toward the shaft. The metal ribs and stretcher members are pivoted on the mounting members by means of a wire which is looped around each mounting member and threaded through the ends of the ribs and stretchers, the ends of the wire loop being twisted together to draw the loop tightly around the mounting member.

The operation of threading the wire loop through the ends of the ribs is difficult and time-consuming. The metal frame members, as well as the wire loops, tend to become bent and kinked or corroded, or both, causing malfunctioning during opening and closing of the umbrella. Moreover, the electrical conductivity of the metal frame makes the use of such umbrellas hazardous during electrical storms.

DISCLOSURE OF THE INVENTION

The present invention comprises an umbrella frame which is easily assembled and constructed mainly or wholly of plastic parts.

It is an object of the present invention to provide an improved umbrella frame in which the ribs and stretcher members are made of non-conductive plastic material.

Another object is to provide an improved umbrella frame having novel retainer means for cooperating with novel mounting members to pivotally connect the ribs and stretcher members to the mounting members.

A further object is to provide improved locking means between the retainer means and the mounting members.

These and other objects are obtained by the improvements comprising the present invention, a preferred embodiment of which is shown in the accompanying drawings by way of example as the best known mode of carrying out the invention, and is described in the following specification. Various modifications and changes in details of construction are comprehended within the scope of the appended claims.

PREFERRED EMBODIMENT FOR CARRYING OUT THE INVENTION

Figure 1:
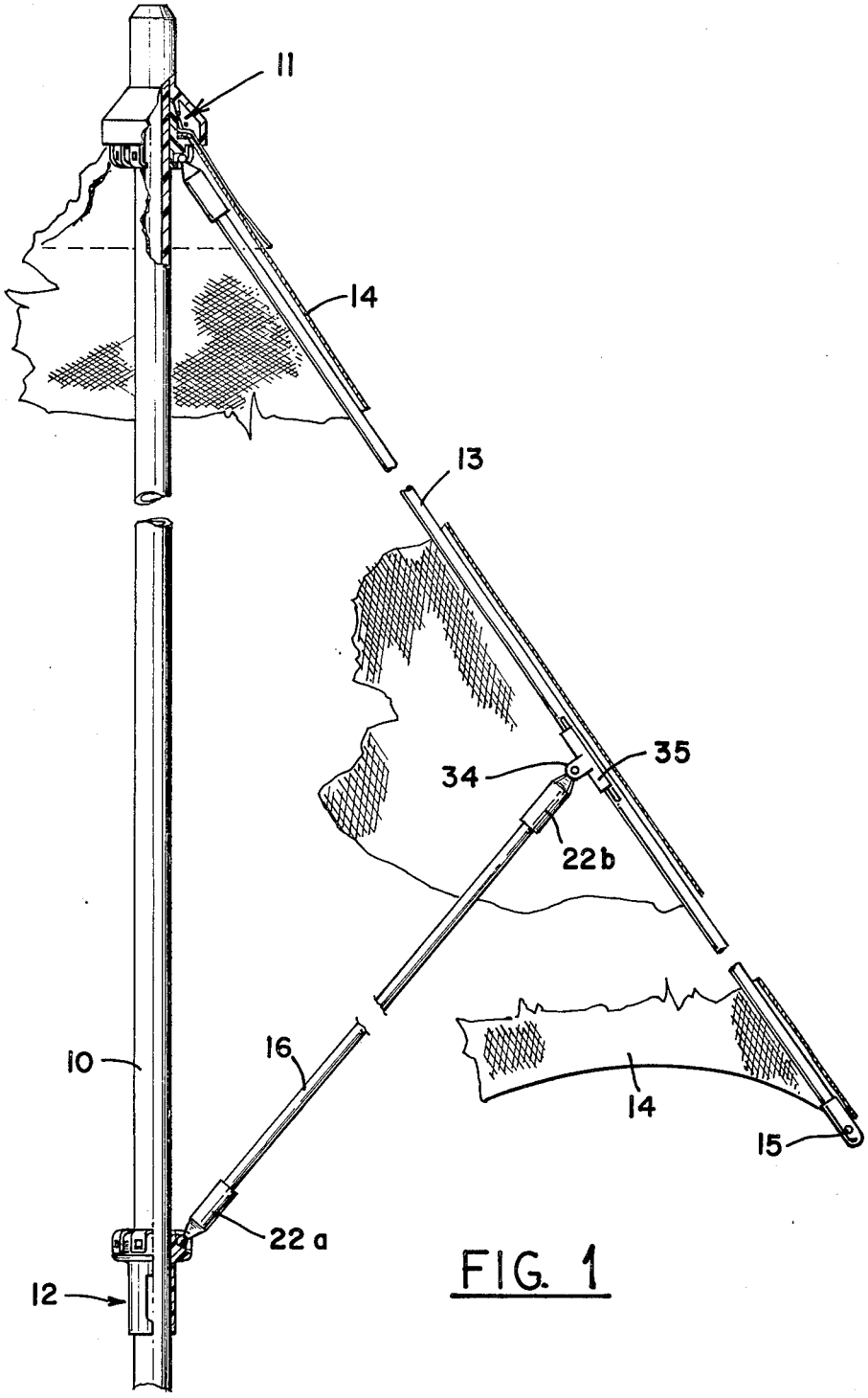
FIG. 1 is a partial elevation of the improved umbrella frame in partly open position.

Referring first to FIG. 1, the central shaft of the improved umbrella frame is indicated at 10, with an upper mounting member indicated generally at 11 fixed on the upper end of the shaft and a lower mounting member or runner indicated generally at 12 slidable on the lower part of the shaft. A circular series of ribs have their upper ends pivoted in the upper mounting member 11, one such rib 13 being shown in FIG. 1.

The weatherproof membrane indicated at 14 extends from above the upper mounting member over the ribs and its lower marginal edge is attached to the lower ends of the ribs 13 at 15. A circular series of stretcher members 16 are pivotally connected, one to an intermediate portion of each rib, and the opposite ends of members 16 are pivotally connected to the runner 12.

Figure 2:
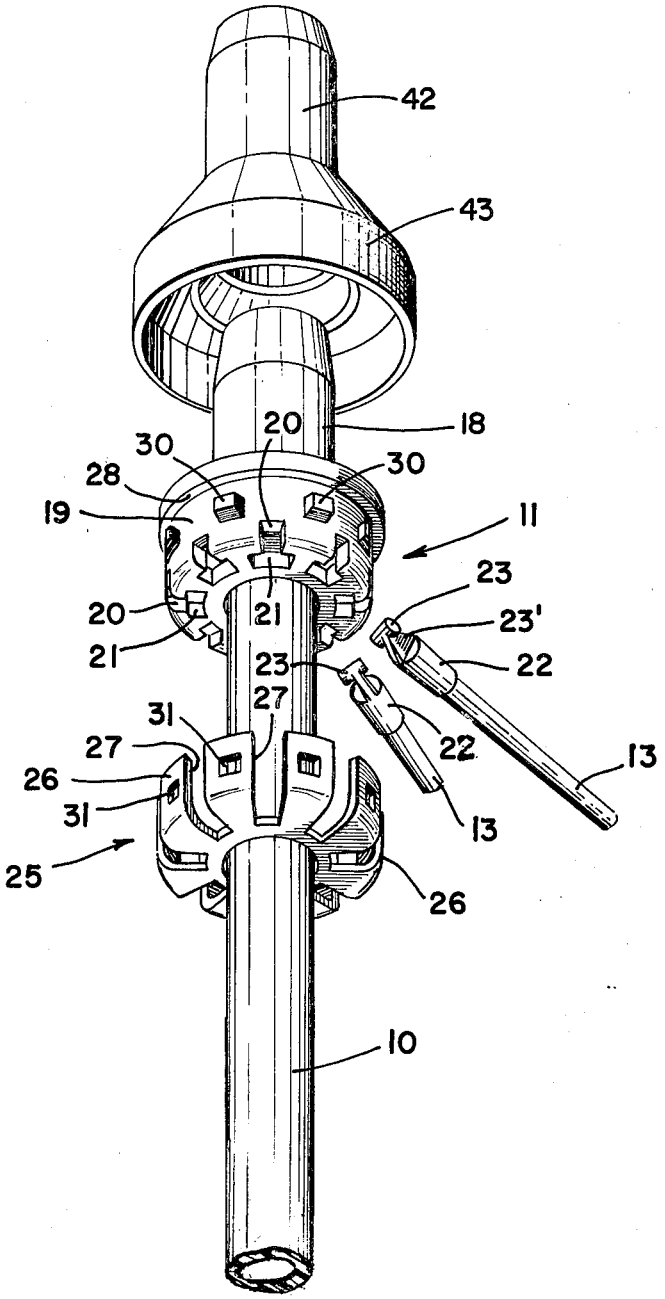
FIG. 2 is an enlarged exploded perspective of the top cap, retainer and upper rib mounting plate on the upper end of the shaft.
Figure 3:
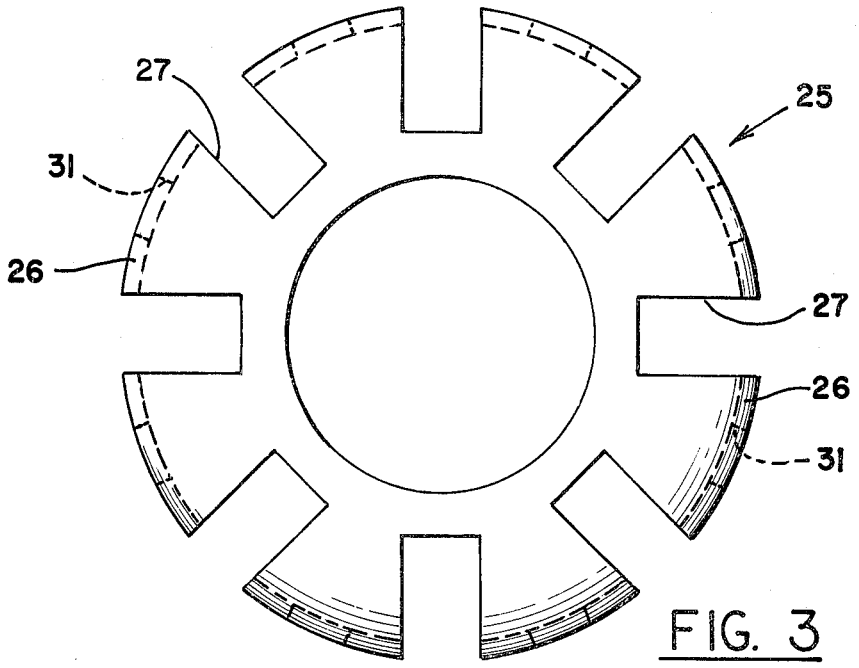
FIG. 3 is an enlarged top plan of the retainer plate.
Figure 4:
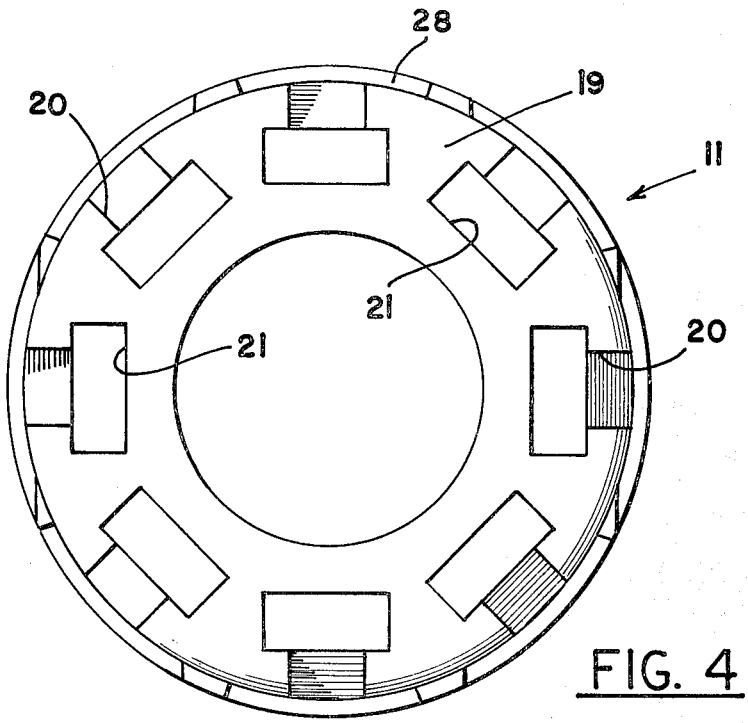
FIG. 4 is an enlarged top plan of the upper rib mounting plate.

Referring to FIG. 2, the upper mounting member 11 has a tubular portion 18 which telescopes over the upper end of shaft 10 with a force fit. The body 19 of the member 11 has a circular series of T-shaped sockets in its lower end, and as shown in FIGS. 2 and 4 the sockets have radially directed outwardly open slots 20 connecting with transverse axially directed sockets 21. The upper ends of the ribs or rods 13 have cylindrical fittings 22 thereon with transverse pivots 23 carried on end flanges 23' adapted to be received in the sockets 21 with the end flanges projecting through the radial slots 20.

A cup-shaped retainer plate indicated generally at 25 is telescoped over the shaft 10 below the mounting member 11, and the plate 25 has a circumferential series of axially upwardly directed flanges 26 separated by slots 27. The flanges 26 are adapted to frictionally engage and fit over the body 19 of member 11 with the slots 27 registering with the slots 20. An annular stop shoulder 28 is preferably provided at the top of body 19, against which the flanges 26 are adapted to abut when they are engaged over the body 19.

Improved means for locking the retainer flanges and the body 19 preferably comprises rectangular studs 30 located on the body between the slots 20 and rectangular openings 31 in the flanges 26 adapted to receive the studs when the flanges are slid over the body into abutment with the annular stop flange. The flanges 26 are sufficiently resilient to allow the openings 31 therein to snap over the studs 30 into locking engagement therewith.

Before interfitting the members 11 and 25, the end pivots 23 on the ribs are inserted into the slots 21 with the end flanges 23' extending through the slots 20. The retainer plate is then snapped over the body 19 with the flanges 23' of the fittings 22 extending through the slots 27 and the ribs 13 are in position to be extended or folded in the manner indicated in FIG. 1.

Figure 6:
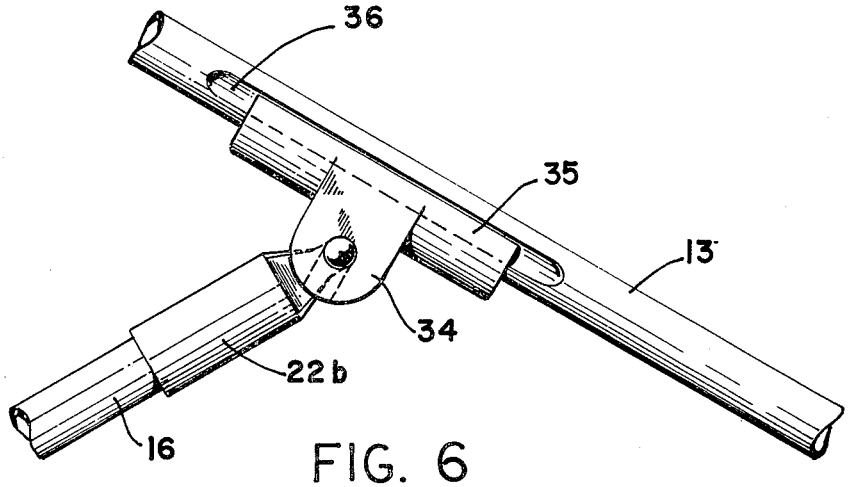
FIG. 6 is an enlarged partial section showing the pivot connection between an outer rib and stretcher member.

The circular series of stretcher members 16 preferably have end fittings **22*a* and 22*b* on their outer ends substantially identical with the end fittings 22, and as best shown in FIGS. 1 and 6 the fittings 22*b* are pivotally connected to flanges 34 on U-shaped clips 35 secured on intermediate portions of the ribs 13. The legs of the clips may be resiliently engaged in grooves 36 in the ribs 13**.

Figure 5:
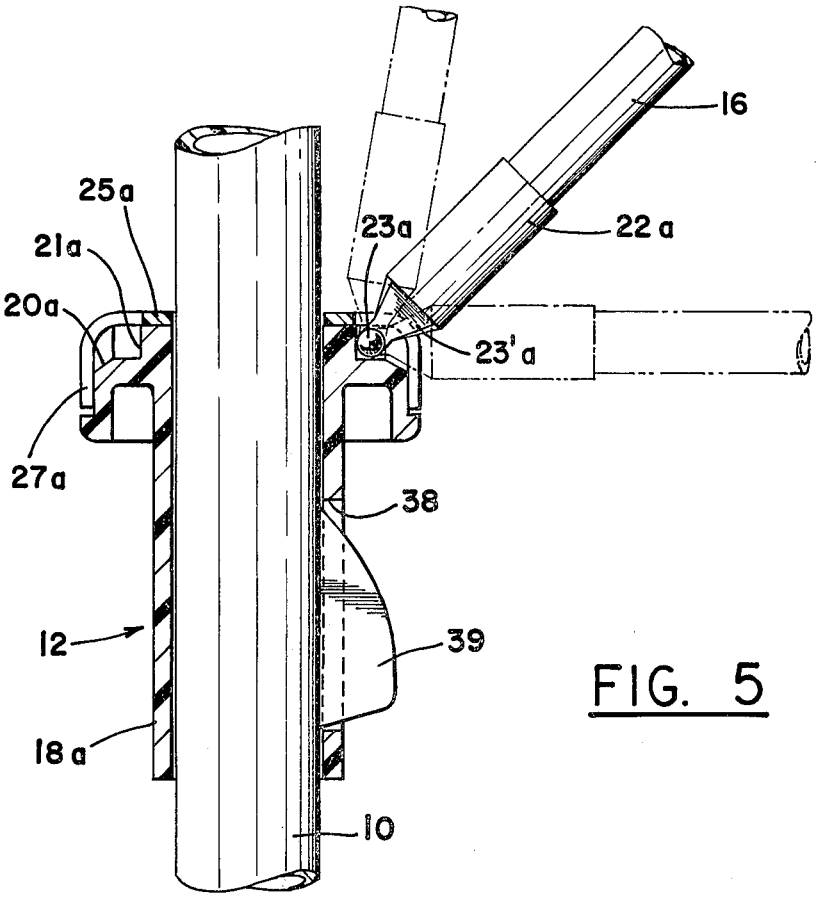
FIG. 5 is an enlarged partial section of the assembled retainer plate and mounting plate, showing the pivot connection of one rib.

The fittings 22*a* are pivotally connected to the lower mounting member or runner 12 which is substantially the same construction as the upper mounting member 11 except that it is in inverted position and slidable on the shaft 10, as best shown in FIG. 5. The tubular portion 18*a* preferably has a slot 38 to receive the usual spring-biased finger latch 39 to hold the runner in the frame folded position.

The runner 12 has substantially the same circular series of sockets 21*a* connected with radial openings 20*a* registering with slots 27*a* in the retainer plate 25*a*, and the pivots 23*a* are received in the sockets 21*a* with the flanges 23'*a* extending through the slots 27*a* to allow the stretcher rods 16 to fold and extend the ribs 13.

In assembling the improved umbrella frame, the end fittings 22 and 22*a* and 22*b* are fitted on the ends of the ribs 13 and stretcher rods 16 and the stretcher rods connected to the clips 35 on the ribs 13 preferably by jig fixturing. The upper and lower mounting members 11 and 12 are located on the shaft 10 and the pivots 23 and 23*a* placed in the sockets 21 and 21*a*, and the retainer plates 25 and 25*a* pressed over the respective mounting members. The entire frame is thus held together in operative relationship without requiring threading a wire through the parts and twisting the ends to tighten the loop.

A substantially conical membrane may now be applied over the frame with the upper central portion of the membrane surrounding the tubular portion 18 of the upper mounting member. A cap member 42 may now be telescoped over the tubular portion 18 to pinch and hold the membrane, and the cap member preferably has an outer annular flange 43 encircling the upper portion of the body 19 of mounting member 11.

Preferably, the shaft 10, ribs 13 and stretcher rods 16 are made of plastic material such as fiber reinforced resin, fiberglass, or fiberglass-epoxy and fiberglass-polyester composites, all of which are electrically non-conductive. Further, the end fittings 22, 22*a* and 22*b*, and the upper and lower mounting members and retainer plates, together with the cap member 42 may also be molded plastic material.

It will be apparent that an improved umbrella frame has been provided which is electrically non-conductive, easily assembled, and not subject to corrosion or malfunctioning of the parts.

We claim:

1. In an umbrella having a central shaft and an expansible and foldable membrane, an upper mounting member fixed on the shaft and a lower mounting member slidable on the shaft, a circumferential series of ribs supporting said membrane and having their inner ends pivotally connected to said upper mounting member, a circumferential series of stretcher rods having their inner ends pivotally connected to said lower mounting member and their outer ends pivoted to intermediate portions of said ribs, the improvement comprising retainer plates movable on said shaft and cooperating with said upper and lower mounting members to lock said inner ends of said ribs and said stretcher rods respectively in pivotally connected relation with said mounting members, each mounting member having peripheral cam lugs and each retainer plate having peripheral wings with openings adapted to snap over and lockingly engage said lugs.

2. In an umbrella as defined in claim 1, wherein said ribs and stretcher rods are electrically non-conductive plastic material.

3. In an umbrella as defined in claim 1, wherein the inner ends of the ribs and stretcher rods have transverse pivots and the upper and lower mounting members have circular series of T-shaped slots for receiving said transverse pivots with the adjoining portions of the ribs and stretcher rods extending outwardly through the stems of the slots, and the retainer plates have slots between said wings to register with the stems of said T-shaped slots while retaining the ends of said transverse pivots therein.

* * * * *